US008641834B2

(12) United States Patent
Yamamoto et al.

(10) Patent No.: US 8,641,834 B2
(45) Date of Patent: Feb. 4, 2014

(54) METHOD FOR MANUFACTURING ELECTRIC CONTACT MATERIAL, ELECTRIC CONTACT MATERIAL, AND THERMAL FUSE

(75) Inventors: Toshiya Yamamoto, Tomioka (JP); Kazuyasu Takada, Tomioka (JP); Kiyokazu Kojima, Tomioka (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 1058 days.

(21) Appl. No.: 12/309,275

(22) PCT Filed: May 20, 2008

(86) PCT No.: PCT/JP2008/059250

§ 371 (c)(1),
(2), (4) Date: Jan. 13, 2009

(87) PCT Pub. No.: WO2008/149666

PCT Pub. Date: Dec. 11, 2008

(65) Prior Publication Data

US 2009/0322464 A1 Dec. 31, 2009

(30) Foreign Application Priority Data

Jun. 7, 2007 (JP) ..... 2007-152004

(51) Int. Cl.

| | |
|---|---|
| ***C23C 8/06*** | (2006.01) |
| ***C22C 5/00*** | (2006.01) |
| ***C22C 5/06*** | (2006.01) |

(52) U.S. Cl.
USPC ..... 148/281; 148/430; 148/431; 337/298

(58) Field of Classification Search
USPC ..... 148/281, 400, 430, 431; 337/298
See application file for complete search history.

(56) References Cited

U.S. PATENT DOCUMENTS

2003/0112117 A1 6/2003 Miyashita et al.

FOREIGN PATENT DOCUMENTS

| | | | |
|---|---|---|---|
| JP | A-51-2619 | | 1/1976 |
| JP | 56102536 A | * | 8/1981 |
| JP | A-58-016039 | | 1/1983 |
| JP | A-63-149341 | | 6/1988 |
| JP | A-06-184664 | | 7/1994 |
| WO | WO 03/009323 A1 | | 1/2003 |

OTHER PUBLICATIONS

Shioda et al., English translation of JP 56-102536A, Aug. 17, 1981, whole document.*

* cited by examiner

*Primary Examiner* — Roy King
*Assistant Examiner* — Caitlin Kiechle
(74) *Attorney, Agent, or Firm* — Oliff PLC

(57) ABSTRACT

A method for manufacturing an electric contact material in which a surface layer portion of an alloy containing 1 to 15 mass % of Cu, 0.01 to 0.7 mass % of Ni, and the remainder of Ag and unavoidable impurities is supplied with an amount of oxygen exceeding the amount of oxygen required for internal oxidation of Cu to form an oxygen concentrated layer.

3 Claims, 4 Drawing Sheets

METHOD FOR MANUFACTURING ELECTRIC CONTACT MATERIAL, ELECTRIC CONTACT MATERIAL, AND THERMAL FUSE

TECHNICAL FIELD

The present invention relates to a method for manufacturing an electric contact material, an electric contact material, and a thermal fuse. In particular, the invention relates to a method for manufacturing an electric contact material which can realize improved durability when used for an electric contact being opened or closed. The invention also relates to an electric contact material manufactured by the method and a thermal fuse which is formed of the electric contact.

BACKGROUND ART

Conventionally, Ag and Ag alloys have been used as electric contact materials, which have a high electric conductivity and good resistance to oxidation.

On the other hand, there was a problem that the contact exposed to a high temperature resulting from an arc induced by an electric current being turned on or off causes adhesion of melted contact. For example, the adhesion due to melting may occur in a thermal fuse by generating an arc induced between a movable electrode and a lead wire which are responsible for turning on or off of the current.

In contrast to this, a thermal fuse free from an adhesion trouble due to melting is described in the International Publication No. WO 03/009323. This thermal fuse can be provided with a movable electrode formed of a material that can be obtained by internally oxidizing an alloy composed of 99 to 80 parts by weight of Ag and 1 to 20 parts by weight of Cu so as to make an oxide-lean surface layer thereof in a thickness of 5 μm or less, with the average particle diameter of the oxide particles present inside the alloy being 0.5 to 5 μm.

According to the description, the material used for the movable electrode of the thermal fuse disclosed in the International Publication No. WO 03/009323 allows an oxide-lean layer to exist on its surface layer so long as it is 5 μm or less in thickness. In fact, according to first to 18th examples described in Patent Document 1, the oxide-lean layer of any of the examples is not 0 μm but 1 to 4 μm in thickness, thus allowing the presence of the oxide-lean layer on the surface layer.

However, the present inventor has found through studies that the oxide-lean layer present on the surface layer, even with a thickness thereof being 5 μm or less, can readily cause adhesion due to melting. Thus, it cannot be said that an electric contact formed of the material described in the International Publication No. WO 03/009323 had satisfactorily addressed the problem of adhesion due to melting.

DISCLOSURE OF THE INVENTION

The present invention was developed in view of the problem. It is therefore an object of the present invention to provide a method for manufacturing an electric contact material which can prevent it from being adhesively melted even when being exposed to high temperatures resulting from an arc induced by an electric current being turned on or off. It is another object of the invention to provide an electric contact material and a thermal fuse which are obtained using this method.

The present inventor has made intensive research and studies to solve the aforementioned problem. As a result, it was found that the aforementioned problem could be solved by supplying a more than a given amount of oxygen to the surface layer portion of the Ag—Cu—Ni alloy of a predetermined composition. This has lead to the present invention.

That is, a first aspect of a method for manufacturing an electric contact material according to the present invention is characterized by supplying to a surface layer portion of an alloy an amount of oxygen exceeding the amount of oxygen required for internal oxidation of Cu to form an oxygen concentrated layer, the alloy containing 1 to 15 mass % of Cu, 0.01 to 0.7 mass % of Ni, and the remainder of Ag and unavoidable impurities.

Here, the surface layer portion of the alloy refers to the region in the range of approximately 20 μm from the alloy surface. The oxygen concentrated layer is formed on the surface layer portion of the Ag—Cu—Ni alloy with oxygen present in solid solution and has a higher concentration of solid solution oxygen than in the Ag—Cu—Ni alloy matrix at the center portion.

A second aspect of a method for manufacturing an electric contact material according to the present invention is characterized by subjecting an alloy to an internally oxidizing process, the alloy containing 1 to 15 mass % of Cu, 0.01 to 0.7 mass % of Ni, and the remainder of Ag and unavoidable impurities, and subjecting the alloy to an oxygen concentration process for forming an oxygen concentrated layer, so as to form an oxygen concentrated layer at least in a range of from the surface to a depth of 0.1 μm or more.

A third aspect of a method for manufacturing an electric contact material according to the present invention is characterized by: subjecting an alloy to an internally oxidizing process, the alloy containing 1 to 15 mass % of Cu, 0.01 to 0.7 mass % of Ni, and the remainder of Ag and unavoidable impurities, the internally oxidizing process being carried out for 6 to 60 hours at a temperature of 500 to 770° C. and at a partial oxygen pressure of 0.02 MPa or more and 1.0 MPa or less; lowering the temperature; and subjecting the alloy to an oxygen concentration process which is carried out for 6 to 24 hours at a temperature of 100 to 300° C. and at a partial oxygen pressure of 0.02 MPa or more and 1.0 MPa or less.

An electric contact material according to the present invention can be obtained using the manufacturing method described above.

A thermal fuse according to the present invention is characterized by having a movable electrode formed of the electric contact material.

The method for manufacturing an electric contact material according to the present invention makes it possible to manufacture an electric contact material which can prevent it from being adhesively melted even when being exposed to high temperatures resulting from an arc induced by an electric current being turned on or off.

Furthermore, the electric contact formed of the electric contact material according to the present invention is resistant to adhesion due to melting and can be used, for example, as a movable electrode of a thermal fuse to provide the thermal fuse with good resistance to adhesion due to melting and good characteristics.

BEST MODE FOR CARRYING OUT THE INVENTION

Figure 1:
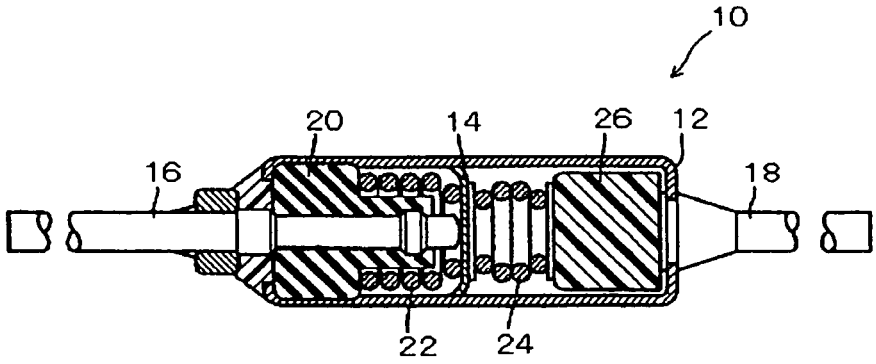
FIG. 1 is a cross-sectional view illustrating the normal state of a thermal fuse with a movable electrode formed of an electric contact material according to an exemplary embodiment of the present invention.

A description will now be made in more detail to the present invention with reference to the exemplary embodiments.

An electric contact material according to an exemplary embodiment of the present invention has an oxygen concentrated layer on the surface layer portion of an Ag—Cu—Ni alloy. The alloy contains 1 to 15 mass % of Cu, 0.01 to 0.7 mass % of Ni, and the remainder of Ag and unavoidable impurities. The oxygen concentrated layer is obtained by supplying to the surface layer portion of the alloy an amount of oxygen exceeding the amount of oxygen required for internal oxidation of Cu.

[With Regard to Cu]

When internally oxidized, Cu serves to supply CuO particles into the Ag—Cu—Ni alloy. The Ag—Cu—Ni alloy having CuO particles scattered in a range at least from its surface to a predetermined depth or more hardly causes adhesion due to melting when the alloy is employed as an electric contact for turning on or off an electric current.

The Cu content to be internally oxidized in the Ag—Cu—Ni alloy needs to be 1 to 15 mass %. A Cu content less than 1 mass % leads to a less number of CuO particles in the Ag—Cu—Ni alloy, thereby causing adhesion due to melting to readily occur when the alloy is used with an electric contact for turning on or off an electric current. On the other hand, with a Cu content above 15 mass %, even when oxygen is forced into the Ag—Cu—Ni alloy through the internal oxidation, a large number of Cu atoms in the alloy causes the oxygen to combine with the Cu into oxide film before going through the surface. This results in no CuO particles being scattered in the alloy. The oxide film formed on the surface leads to a significant increase in contact resistance.

CuO particles serve to retard adhesion due to melting when the Ag—Cu—Ni alloy is used with an electric contact for turning on or off an electric current. CuO particles are preferably scattered in a range of from the surface of the Ag—Cu—Ni alloy to a depth of 5 μm or more, with their average particle diameter being preferably 5 μm or less.

[With Regard to Ni]

Ni serves to make CuO particles finer. CuO particles above 5 μm in the average particle diameter cause an excessive increase in contact resistance, thereby making the alloy incompatible with an electric contact material.

The Ni content in the Ag—Cu—Ni alloy to be internally oxidized needs to be 0.01 to 0.7 mass %. A Ni content of less than 0.01 mass % is not enough to make CuO particles finer. On the other hand, it is impossible for the ordinary dissolution process to provide a Ni content of more than 0.7 mass %.

[With Regard to Oxygen Concentrated Layer]

As described above, the oxygen concentrated layer, which exists on the surface layer portion of the Ag—Cu—Ni alloy, has oxygen present in solid solution in an Ag matrix, with a higher oxygen concentration than in the Ag matrix at the center. The oxygen concentrated layer serves to prevent CuO from being reduced even when an arc occurs while an electric contact formed of the Ag—Cu—Ni alloy having scattered CuO particles is used to turn on or off the current. Furthermore, with the Ag—Cu—Ni alloy, oxygen atoms are thermodynamically more stable when they have combined with Cu into CuO than when they are present in solid solution in the Ag—Cu—Ni alloy. This ensures that CuO particles are always present in the oxygen concentrated layer.

CuO particles have a melting point of 1000° C. or higher, which is higher than the melting point of the Ag—Cu—Ni alloy of approximately 810° C. Thus, the Ag—Cu—Ni alloy having a predetermined amount or more of CuO particles present on the surface layer portion thereof hardly causes adhesion due to melting to occur even when an arc is induced using an electric contact formed of the Ag—Cu—Ni alloy.

However, an arc may occur, thereby causing CuO particles to be reduced into metal copper and then producing an oxide lean layer of an oxide concentration of approximately less than 1 mass % on the surface layer portion of the Ag—Cu—Ni alloy. In this case, a less amount of CuO particles contained in the oxide lean layer is likely to cause adhesion due to melting.

In contrast to this, the oxygen concentrated layer has a high oxygen concentration and thus prevents CuO particles from being reduced even when an arc occurs by turning on or off the current, thereby preventing an oxide lean layer from being produced. Accordingly, the presence of the oxygen concentrated layer on the surface layer portion of the Ag—Cu—Ni alloy prevents the occurrence of adhesion due to melting.

The oxygen concentrated layer is preferably 0.1 μm or more in thickness from the alloy surface. Upon occurrence of an arc while the current is turned on or off, the oxygen concentrated layer having a thickness of less than 0.1 μm from the alloy surface is not enough to prevent CuO from being reduced or maintain the preventive effect for a long time.

[With Regard to a Manufacturing Method]

A description will now be made to a method for manufacturing an electric contact material according to an exemplary embodiment of the present invention.

A method for manufacturing an electric contact material according to an exemplary embodiment of the present invention is characterized by supplying to a surface layer portion of an Ag—Cu—Ni alloy an amount of oxygen exceeding the amount of oxygen required for internal oxidation of Cu to form an oxygen concentrated layer, the alloy containing 1 to 15 mass % of Cu, 0.01 to 0.7 mass % of Ni, and the remainder of Ag and unavoidable impurities.

Each component of the Ag—Cu—Ni alloy to which oxygen is supplied and the oxygen concentrated layer are as discussed above, and thus will not be described in more detail here. The following description will be mainly directed to the process of supplying oxygen into the alloy.

The process of supplying oxygen into the alloy may be implemented as the internal oxidation process and the oxygen concentration process.

(Internal Oxidation Process)

The internal oxidation is a phenomenon in which oxygen atoms diffuse into metal to form oxide inside the metal. This phenomenon occurs because oxygen atoms diffuse into the metal faster than metal atoms reach the surface, thereby causing no oxide film to be formed on the surface of the metal. This phenomenon is observed with a specific alloy, for example, an Ag alloy.

The internal oxidation process is carried out in three conditions: the thermal treatment temperature, the partial oxygen pressure, and the thermal treatment time.

The thermal treatment temperature is preferably 600 to 800° C. A thermal treatment temperature of less than 600° C. does not allow oxygen atoms to diffuse sufficiently into the Ag—Cu—Ni alloy, thereby making it difficult to oxidize internally sufficiently a range from the alloy surface to a certain depth or more. On the other hand, the Ag—Cu—Ni alloy containing 1 to 15 mass % of Cu and 0.01 to 0.7 mass % of Ni has a melting point of approximately 810° C., and thus possibly melts at a thermal treatment temperature greater than 800° C.

The partial oxygen pressure is preferably 0.02 MPa or more and 1.0 MPa or less. A partial oxygen pressure of less than 0.02 MPa makes it difficult to supply a sufficient amount of oxygen required for internal oxidation into the Ag—Cu—Ni alloy. On the other hand, a partial oxygen pressure of 1.0 MPa or more uneconomically makes the equipment for the internal oxidation process massive.

The thermal treatment time is preferably 24 to 60 hours. A thermal treatment time of less than 24 hours makes it difficult to supply into the Ag—Cu—Ni alloy a sufficient amount of oxygen required for internal oxidation. On the other hand, a thermal treatment time of above 60 hours contributes only a slight increase in the amount of oxygen to be supplied into the Ag—Cu—Ni alloy when compared with a thermal treatment time of 60 hours. It is thus not economical to employ a longer thermal treatment time than 60 hours.

(Oxygen Concentration Process)

In the case of the Ag—Cu—Ni alloy, oxygen atoms are thermodynamically more stable when they have combined with Cu into CuO than when they are present in solid solution in the Ag—Cu—Ni alloy. Therefore, oxygen atoms present in solid solution in the Ag—Cu—Ni alloy and diffused into the alloy combine with neighboring Cu atoms, if any, into CuO. Accordingly, to allow oxygen atoms to exist in solid solution in the Ag—Cu—Ni alloy, it is necessary to supply into the Ag—Cu—Ni alloy a more amount of oxygen than required for the internal oxidation of the Cu.

To allow oxygen atoms to be present in solid solution in the Ag—Cu—Ni alloy as well as to form the oxygen concentrated layer in a predetermined range from the alloy surface, for example, in a range of 0.1 μm or more from the surface, it is necessary to perform an appropriate oxygen concentration process after the internal oxidation process.

In this context, after the internal oxidation process has been carried out under the aforementioned conditions, it is preferable to lower the temperature, and then additionally perform the oxygen concentration process for 6 to 24 hours at a temperature of 100 to 300° C. at a partial oxygen pressure of 0.02 MPa or more and 1.0 MPa or less. This further increases the amount of oxygen atoms present in solid solution on the surface layer portion of the Ag—Cu—Ni alloy. Since the amount of oxygen present in solid solution in the Ag—Cu—Ni alloy can be increased at lower temperatures, the maximum amount of oxygen present in solid solution can be increased at thermal treatment temperatures of 100 to 300° C. However, the thermal treatment temperatures of 100 to 300° C. cause the oxygen atoms to diffuse at reduced speeds. Thus, for the oxygen concentration process within this temperature range, the amount of oxygen atoms present in solid solution increases only on the surface layer portion of the Ag—Cu—Ni alloy.

On the other hand, in order to prevent adhesion due to melting from occurring at an electric contact formed of the Ag—Cu—Ni alloy, it is important to avoid CuO particles on the surface layer portion from being reduced. Therefore, the initial internal oxidation process at thermal treatment temperatures of 600 to 800° C. is performed to produce CuO particles in a range of from the surface of the Ag—Cu—Ni alloy to a certain depth. After that, the oxygen concentration process is performed at thermal treatment temperatures of 100 to 300° C. so as to increase the amount of solid solution oxygen on the surface layer portion of the Ag—Cu—Ni alloy. This series of processes are effective in preventing adhesion due to melting.

This oxygen concentration process may also be performed as another process subsequently after the internal oxidation process has been carried out at a thermal treatment temperature of 600 to 800° C. That is, this additional process may be performed, for example, to gradually decrease the temperature in an environment of a partial oxygen pressure of 0.02 MPa or more and 1.0 MPa or less, and then allow the alloy to be exposed for 6 to 24 hours to temperatures ranging from 100 to 300° C.

[Application to Products]

Figure 2:
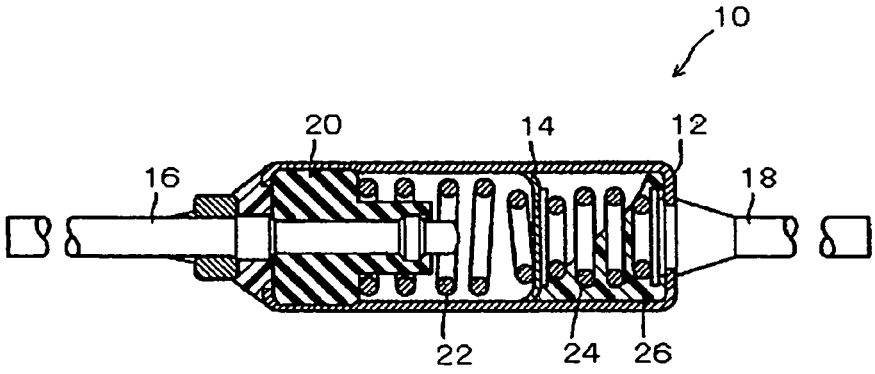
FIG. 2 is a cross-sectional view illustrating the thermal fuse after having been opened.

As shown in FIGS. 1 and 2, the electric contact material according to an exemplary embodiment of the present invention can be preferably used for such a movable electrode 12 for a thermal fuse 10 as described in Patent Document 1. FIG. 1 is a cross-sectional view illustrating the thermal fuse 10 in the normal state, and FIG. 2 is a cross-sectional view illustrating the same after having been opened.

As shown in FIG. 1, the thermal fuse 10 is mainly composed of a metal casing 12, a movable electrode 14, lead wires 16 and 18, an insulating material 20, compressive springs 22 and 24, and a temperature sensitive material 26.

The movable electrode 14 can move in contact with the inner surface of the metal casing 12, which is electrically conductive. The compressive spring 22 is provided between the movable electrode 14 and the insulating material 20, while the compressive spring 24 is interposed between the movable electrode 14 and the temperature sensitive material 26.

In the normal state as shown in FIG. 1, each of the compressive springs 22 and 24 is in a compressed state. The compressive spring 24 is more strongly energized to expand than the compressive spring 22, so that the movable electrode 14 is urged toward the insulating material 20, and the movable electrode 14 is brought into contact with the lead wire 16. Accordingly, with the lead wires 16 and 18 connected to the wiring of an electronic device, an electric current flows through the lead wire 16, the movable electrode 14, the metal casing 12, and the lead wire 18 in that order.

The temperature sensitive material 26 may be formed of an organic substance such as adipic acid having a melting point of 150° C. When the predetermined operating temperature is reached, the temperature sensitive material 26 is softened or melted, so that the compressive spring 24 is relieved from the load and expands. Accordingly, the compressive spring 22 is relieved from the compressed state and expanded, thereby causing the movable electrode 14 and the lead wire 16 to be separated from each other and the current flowing therethrough to be interrupted.

The thermal fuse that functions to interrupt the current in this manner when a predetermined temperature is reached can be connected to the wiring of an electronic device or the like.

This makes it possible to prevent damage to or fire in the main body of the device, which may be caused by the device being overheated.

When the movable electrode 14 and the lead wire 16 are being separated from each other, a microscopic arc may occur between the movable electrode 14 and the lead wire 16. In particular, the arc is likely to occur when the movable electrode 14 and the lead wire 16 are slowly separated from each other. However, the movable electrode 14 formed of the electric contact material according to an exemplary embodiment of the present invention allows only a small amount of CuO particles to be reduced even when an arc occurs. Thus, adhesion due to melting between the movable electrode 14 and the lead wire 16 is strongly suppressed.

Figure 3:
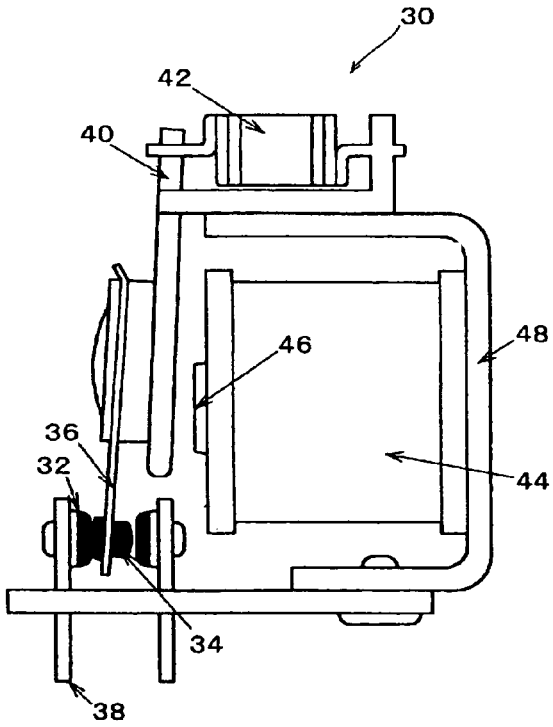
FIG. 3 is a view illustrating an example relay with a stationary contact and a movable contact to which an electric contact material according to an exemplary embodiment of the present invention is applicable.

The electric contact material according to an exemplary embodiment of the present invention can be preferably employed not only for the movable electrode of a thermal fuse but also for an electric contact for turning on or off electric current. For example, the material can also be preferably used for a stationary contact 32 and a movable contact 34 of a relay 30 as shown in FIG. 3. FIG. 3 shows a movable contact piece (contact spring) 36, a terminal 38, an armature (movable iron piece) 40, a return spring 42, a coil 44, an iron core 46, and a yoke 48.

[Example]

To compose the alloy of 95.5 mass % of Ag, 4.0 mass % of Cu, and 0.5 mass % of Ni, each metal was weighted on a scale, melted, cast, then rolled to a thickness of 2 mm, and after the rolling, cut into a size of 30 cm by 30 cm.

The resulting alloy was subjected to the internal oxidation process in an internal oxidation furnace at a thermal treatment temperature of 700° C., at a partial oxygen pressure of 0.5 MPa, for a thermal treatment time of 48 hours. Subsequently, with the partial oxygen pressure kept at 0.5 MPa, the alloy was held at 300° C. for 12 hours to undergo the oxygen concentration process.

Figure 4:
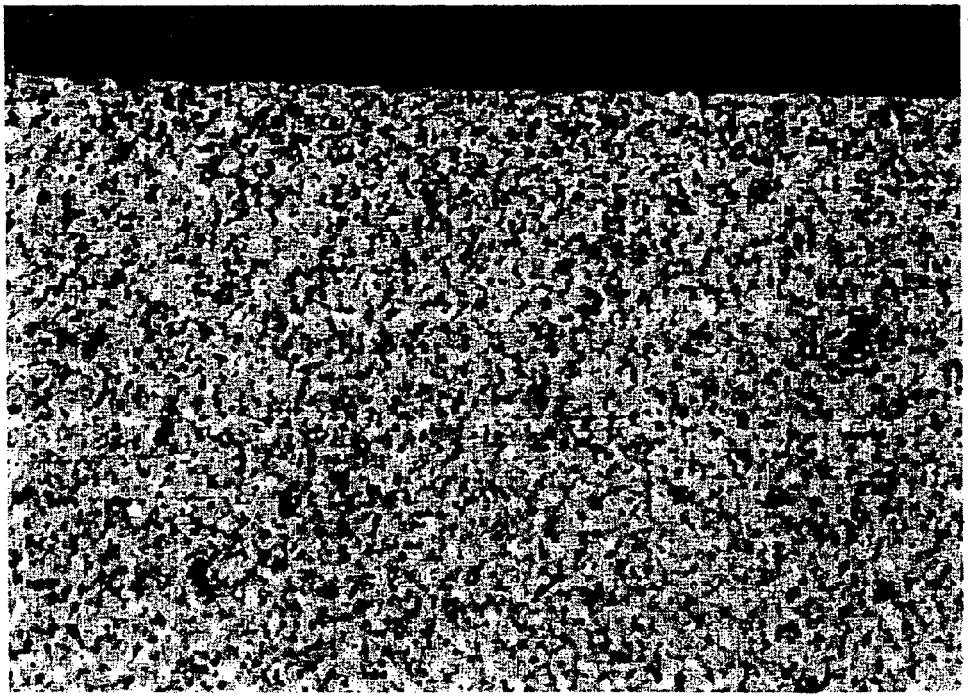
FIG. 4 is a sectional photograph, taken with a metallurgical microscope, of an electric contact material prepared according to an example.

After the oxygen concentration process was carried out, the alloy was cooled down to the room temperature and then cut in the direction of thickness to observe the section by the metallurgical microscope. FIG. 4 shows the sectional photograph taken by the metallurgical microscope. In FIG. 4, the black spots indicate CuO particles, and the white spots indicate Ag—Cu—Ni alloy portions. As can be seen from FIG. 4, the CuO particles have been scattered from the alloy surface into the alloy in a uniform distribution. FIG. 4 shows a section from the alloy surface to a depth of approximately 150 μm, in the range of which no CuO-particle lean layer is present.

Figure 5:
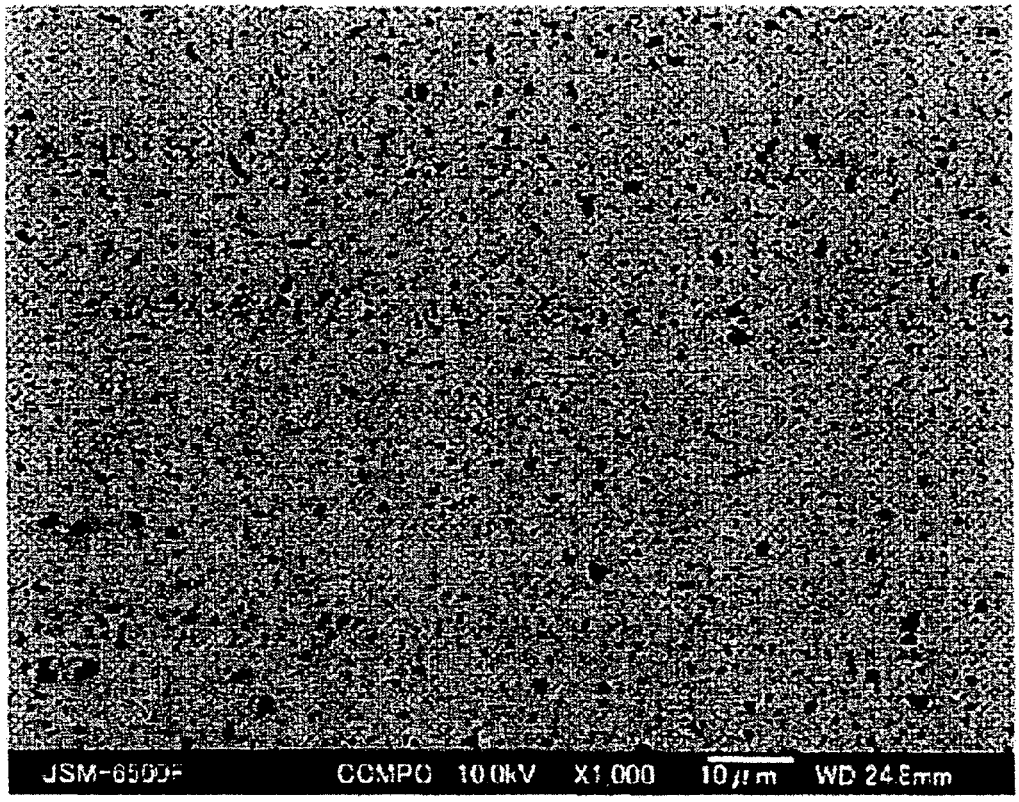
FIG. 5 is an electron micrograph of the surface of an electric contact material prepared according to an example (taken with a low magnification)
Figure 6:
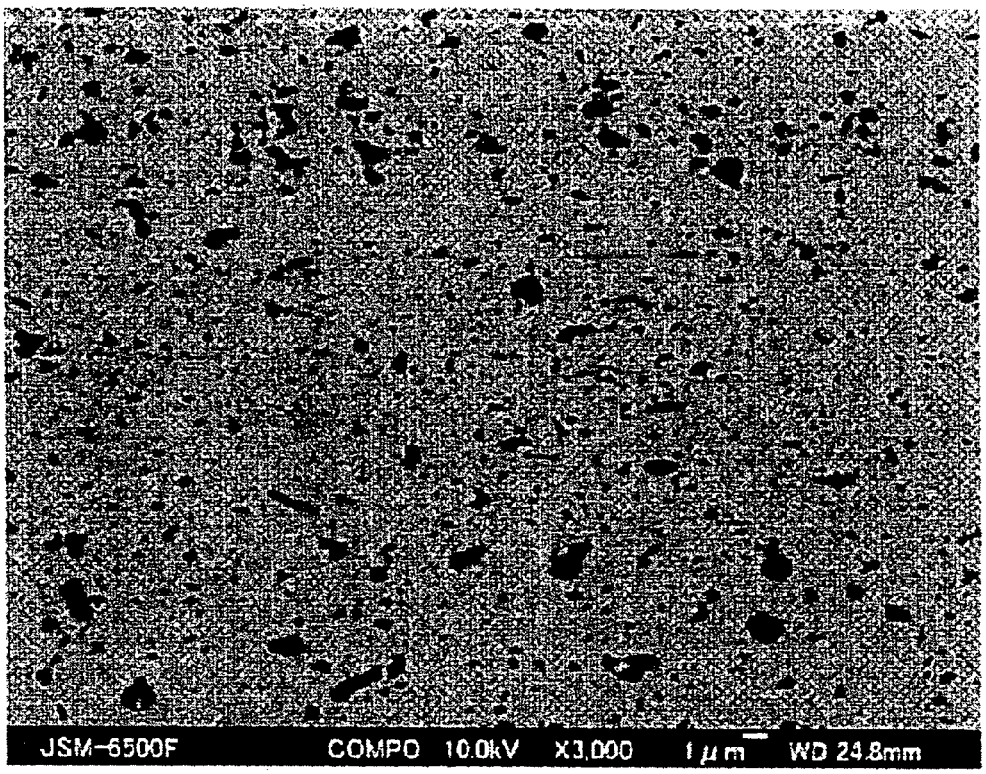
FIG. 6 is an electron micrograph of the surface of an electric contact material prepared according to an example (taken with a high magnification)

FIGS. 5 and 6 are an electron micrograph showing the surface of the alloy which was cooled down to the room temperature after the internal oxidation process. As can be seen from the scale indicated at the bottom of the sectional photograph, the photograph of FIG. 6 was taken with a higher magnification than that of FIG. 5. In FIGS. 5 and 6, the black spots indicate CuO particles, while the white spots indicate Ag—Cu—Ni alloy portions. As can be seen from FIGS. 5 and 6, CuO particles have been scattered on the alloy surface in a generally uniform distribution.

Figure 7:
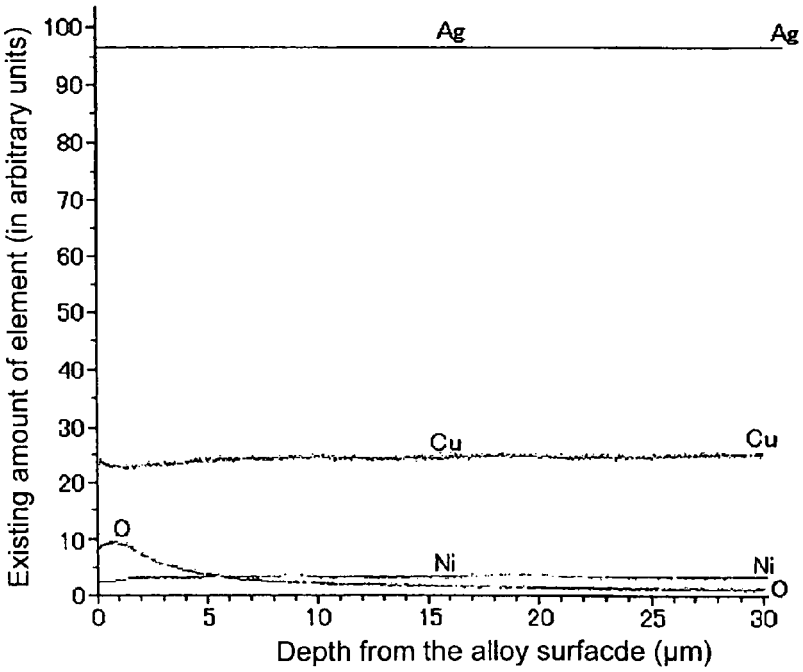
FIG. 7 is a graph illustrating the results obtained by using a glow discharge analyzer GDA 750 (by Rigaku Corporation) to measure the distribution of elements in the direction of depth in an electric contact material prepared according to an example.

FIG. 7 is a graph illustrating the results obtained by using a glow discharge analyzer GDA 750 (by Rigaku Corporation) to measure the distribution of elements in the direction of depth in the alloy which was cooled down to the room temperature after having been subjected to the internal oxidation process. The horizontal axis represents the depth from the surface, and the vertical axis represents the existential quantity of each element. FIG. 7 shows uncalibrated data with the numerical values on the vertical axis being non-quantitative. Thus, although the ratio of existence of each element cannot be known from FIG. 7, it can be read therefrom how the existing amount of each element varies in the direction of depth from the alloy surface.

The existing amount of Ag, Cu, and Ni is generally constant in the direction of depth from the alloy surface. In contrast to this, the existing amount of oxygen is outstandingly immense in a range from the alloy surface to a depth of approximately 2 μm, so the region at a depth of approximately 5 μm has approximately half the existing amount in the range of from the surface to a depth of approximately 2 μm. The region at a depth of approximately 20 μm has approximately one-third the existing amount for the range down to a depth of approximately 5 μm, while the existing amount of oxygen is generally constant in regions at depths of more than 20 μm.

On the other hand, as shown in FIG. 4, CuO particles have been scattered and uniformly distributed in the alloy from the alloy surface to a depth of approximately 150 μm. Therefore, in FIG. 7, the oxygen that increases toward the surface in a region therefrom to a depth of less than 20 μm can be considered as the oxygen that is present in solid solution in the Ag—Cu—Ni alloy. In the region at depths of greater than 20 μm where the amount of oxygen is generally constant, it is thought that most of the oxygen is present in the form of CuO, and almost no oxygen concentrated layer is present.

As can be seen from this, in the range of from the alloy surface to a depth of approximately 2 μm, oxygen is particularly abundant in solid solution in the Ag—Cu—Ni alloy, and CuO particles are also present as much as those in a region at depths of approximately more than 2 μm. Thus, it is thought that an electric contact formed of the resulting alloy will hardly cause adhesion due to melting.

The resulting alloy was used to form a movable electrode in order to turn on and off the current repeatedly while causing an arc. This showed that the number of times of turning on and off the current repeatedly until adhesion due to melting occurred was improved approximately 10% when compared with the movable electrode of a conventional thermal fuse.

INDUSTRIAL APPLICABILITY

The method for manufacturing an electric contact material according to the present invention makes it possible to manufacture an electric contact material which can prevent it from being adhesively melted even when being exposed to high temperatures resulting from an arc induced by an electric current being turned on or off.

Furthermore, an electric contact formed of the electric contact material according to the present invention is resistant to adhesion due to melting. For example, the contact can be used as a movable electrode of a thermal fuse, thereby making the thermal fuse resistant to adhesion due to melting and providing it with good characteristics.

The invention claimed is:

1. A method for manufacturing an electric contact material comprising steps of:

subjecting an alloy to an internally oxidizing process, the alloy containing 1 to 15 mass % of Cu, 0.01 to 0.7 mass % of Ni, and the remainder of Ag and unavoidable impurities, the internally oxidizing process being carried out for 6 to 60 hours at a temperature of 500 to 770° C. and at a partial oxygen pressure of 0.02 MPa or more and 1.0 MPa or less;

lowering the temperature; and subjecting the alloy to an oxygen concentration process which is carried out for 6 to 24 hours at a temperature of 100 to 300° C. and at a partial oxygen pressure of 0.02 MPa or more and 1.0 MPa or less.

2. An electric contact material obtained using the manufacturing method according to claim 1, wherein the electric contact material is an Ag—Cu—Ni alloy comprising:

CuO particles scattered in a surface of the Ag—Cu—Ni alloy to a depth of 5 μm or more from the surface of the alloy, the average CuO particle diameter being 5 μm or less, and an oxygen concentrated layer provided to a surface layer portion of the Ag—Cu—Ni alloy and having a thickness of 0.1 μm or more from the surface of the Ag—Cu—Ni alloy, wherein the oxygen concentrated layer has oxygen present in solid solution within an Ag matrix and has a higher oxygen concentration than an Ag matrix at a center of the Ag—Cu—Ni alloy.

3. A thermal fuse being characterized by having a movable electrode formed of the electric contact material according to claim 2.

* * * * *